US006719539B1

(12) United States Patent
Yoshioka

(10) Patent No.: US 6,719,539 B1
(45) Date of Patent: Apr. 13, 2004

(54) FUEL FEEDER

(75) Inventor: Hiroshi Yoshioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/110,742

(22) PCT Filed: Aug. 18, 2000

(86) PCT No.: PCT/JP00/05528

§ 371 (c)(1),
(2), (4) Date: Apr. 16, 2002

(87) PCT Pub. No.: WO02/16753

PCT Pub. Date: Feb. 28, 2002

(51) Int. Cl.[7] ..... F04B 17/00; F04B 35/00
(52) U.S. Cl. ..... 417/363; 417/423.14; 123/509
(58) Field of Search ..... 417/363, 360, 417/279, 423.3, 423.9, 423.14; 123/509, 510, 511, 457, 497, 514

(56) References Cited

U.S. PATENT DOCUMENTS 4,212,600 A * 7/1980 Otto et al. ..... 417/360
4,869,225 A * 9/1989 Nagata et al. ..... 123/509
5,392,750 A * 2/1995 Laue et al. ..... 123/509
5,511,957 A * 4/1996 Tuckey et al. ..... 417/313
5,778,926 A * 7/1998 Tanaka et al. ..... 137/508
5,782,223 A * 7/1998 Yamashita et al. ..... 123/510
6,123,521 A * 9/2000 Mori et al. ..... 417/423.3

FOREIGN PATENT DOCUMENTS

JP 10-047185 2/1998
WO WO 9803787 A1 * 1/1998
WO WO 96/23966 1/2002

* cited by examiner

*Primary Examiner*—Justine R. Yu
*Assistant Examiner*—Han Lieh Liu
(74) *Attorney, Agent, or Firm*—Sughrue Mion, PLLC

(57) ABSTRACT

The system has a fuel pump disposed in a fuel tank for raising a pressure of a fuel sucked through an intake filter and discharging the fuel, a pressure regulator for regulating the pressure of the fuel discharged from a discharge port, a fuel filter for filtering the fuel discharged from the discharge port, and a pump holding case for hermetically covering the fuel pump and accommodating and holding the fuel pump. A cushion rubber, having a passage for communicating an intake port and the intake filter is interposed between a bottom wall of the pump holding case and the fuel pump.

8 Claims, 6 Drawing Sheets

FUEL FEEDER

TECHNICAL FIELD

The present invention relates to a fuel supply apparatus or supplying a fuel to an engine using a fuel pump disposed in a fuel tank.

BACKGROUND ART

Hitherto, a apparatus described in the International Publication No.WO96/23966 has been known as a fuel supply apparatus for supplying a fuel to an engine. This apparatus is a unified construction in which a fuel pump is accommodated in a pump case through a rubber member, an intake filter is connected to an intake pipe of the fuel pump, a fuel filter for filtering a fuel discharged from the fuel pump is accommodated in a filter case, and the pump case and the filter case are engaged by snap-fitting.

However, in the -construction described in the International Publication No.WO96/23966, the intake pipe side of the fuel pump is exposed to outside from the pump case, and consequently, any noise generated on the intake side of the fuel pump is directly transmitted to the inside of the fuel tank. Such a noise is heard from outside of the fuel tank. The intake pipe of the fuel pump is approximately L-shaped, which is easy to generate a noise when the fuel is sucked. Moreover, the fuel pump and the pump case required to be positioned with respect to the rubber member and the intake pipe respectively, and therefore this apparatus is inferior in assembling efficiency.

DISCLOSURE OF INVENTION

The present invention was made to solve the above-discussed problems and has an object of obtaining an improved fuel supply apparatus of simple structure capable of reducing a noise generated when the fuel pump sucks a fuel.

A fuel supply apparatus according to the invention is a fuel supply apparatus for supplying a fuel to an engine comprising:

a fuel tank; a cylindrical fuel pump disposed in the mentioned fuel tank for raising a pressure of the fuel sucked from an intake port thereof and discharging the fuel from a discharge port thereof; an intake filter for filtering the fuel in the mentioned fuel tank and supplying the fuel to the intake port of the fuel pump; a pressure regulator for regulating a pressure of the fuel discharged from the discharge port of the mentioned fuel pump; and a holding case hermetically covering at least the intake port side of the fuel pump and accommodating, and holding the fuel pump. As a result of such construction, it is possible to reduce any noise generated when the fuel pump sucks the fuel and simplify the structure.

The holding case is provided with a first connecting portion to be connected to a fuel filter and a second connecting portion to be connected to the intake port of the fuel pump. As a result, it is possible to further reduce the noise generated when the fuel pump sucks the fuel. The intake port of the second connection portion of the holding case are connected through a bypass formed by a rubber member disposed in the holding case. As a result, it is not necessary to use special connecting pipe for connecting them, and number of parts can be reduced as to compare with prior apparatus.

The rubber member is interposed between the fuel pump and the holding case, and serves as a cushion for the mentioned fuel pump. As a result, the system is small-sized and the system is assembled easily.

The bypass is formed with a groove provided on the rubber member and an inner peripheral wall of the holding case, and the mentioned groove is formed to communicate to the second connecting portion of the holding case and to the intake port of the fuel pump. As a result, the system is assembled easily.

The rubber member is interposed between an outer circumference of the fuel pump and an inner circumference of the holding case and is provided with a partition for partitioning the bypass. As a result, only the fuel that has passed through the intake filter is supplied to the bypass, and the fuel is supplied stably.

The holding case hermetically accommodates the pressure regulator and is provided with a fuel holding portion for holding the fuel discharged from the pressure regulator and a flowing out portion for flowing out the fuel to the fuel tank when the fuel in the mentioned fuel holding portion exceeds a predetermined amount. As a result, it is possible to reduce the noise generated when the fuel passes through the pressure regulator.

The flowing out portion is formed into plural holes. As a result, it is possible to reduce the noise generated when the fuel is flowed out from these holes.

BEST MODE FOR CARRYING OUT THE INVENTION

Embodiments of the invention are hereinafter described in detail.

Embodiment 1

Figure 1:
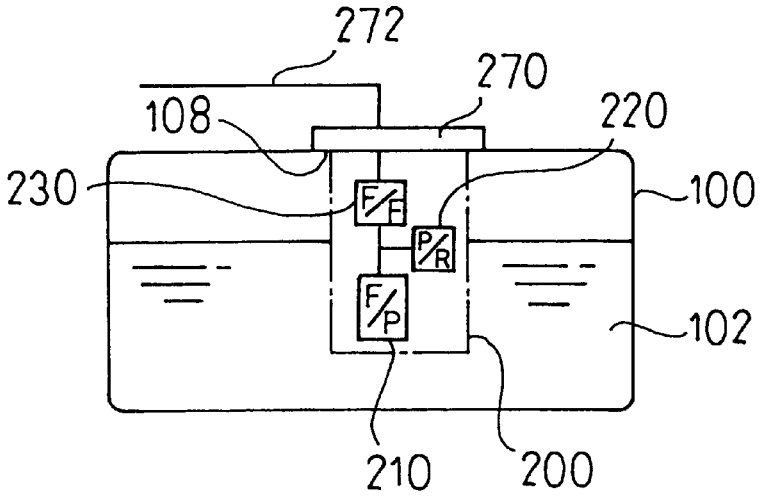
FIG. 1 a schematic view of a fuel supply apparatus according to Embodiment 1 of the invention.

FIG. 1 is a schematic view of a fuel supply apparatus according to Embodiment 1 of the invention. In FIG. 1, reference numeral 100 is a fuel tank made of a metal for accommodating a fuel 102, and the fuel tank 100 is provided with an opening 108 in which a fuel pump unit 200 is inserted. Numeral 200 is the fuel pump unit including a fuel pump (F/P) 210 for raising a pressure of the fuel 102 and discharging it, a pressure regulator (P/R) 220 for keeping the discharging pressure of the fuel pump 210 at a predetermined value, and a fuel filter (F/F) 230 for filtering the fuel discharged from the fuel pump 210. Numeral 270 is a flange made of a metal for sealing the opening 108 fluid-tight after installation of the fuel pump unit 200, and numeral 272 is a delivery pipe for delivering the fuel supplied from the fuel pump unit 200 to an engine not shown.

Figure 2:
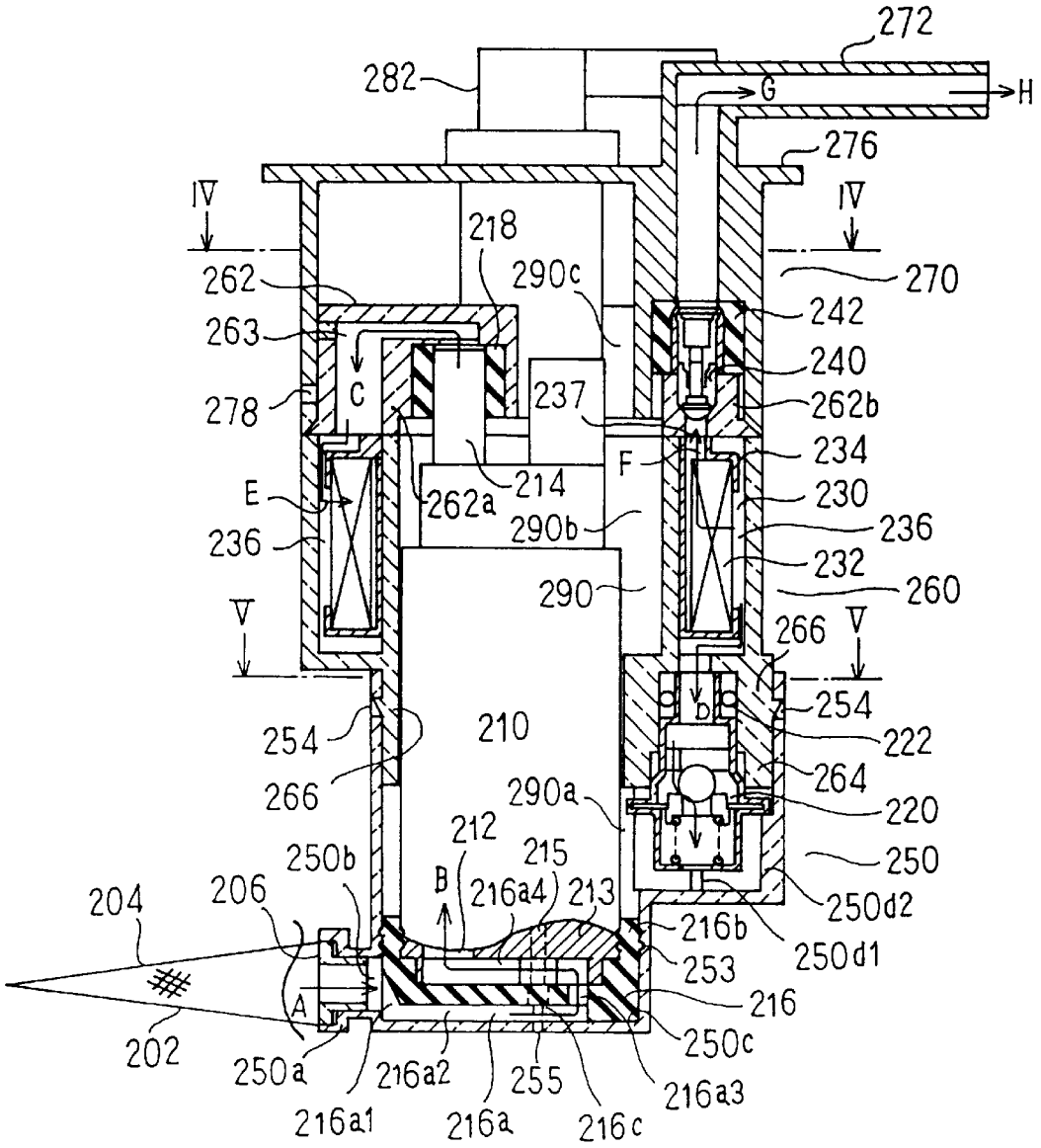
FIG. 2 is a partially enlarged sectional view showing a fuel pump unit of the fuel supply apparatus in FIG. 1.
Figure 3:
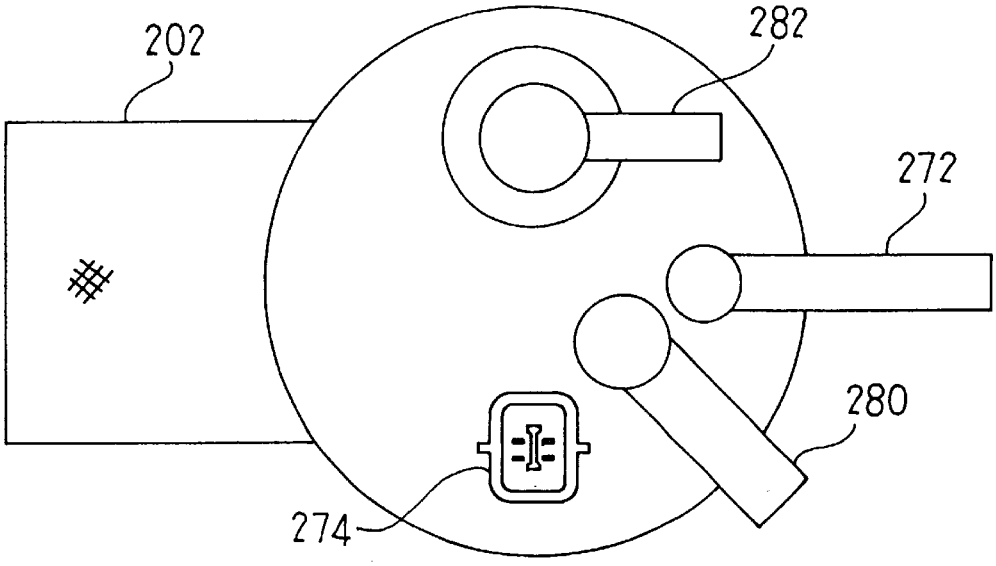
FIG. 3 is a top view of the fuel pump unit portion in FIG. 2.
Figure 4:
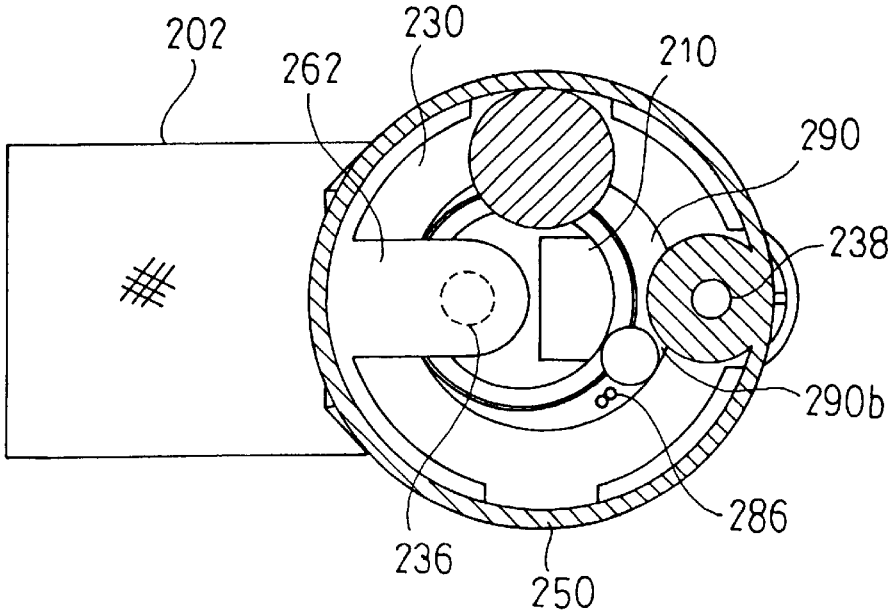
FIG. 4 is a sectional view taken along the line IV—IV in FIG. 2.
Figure 5:
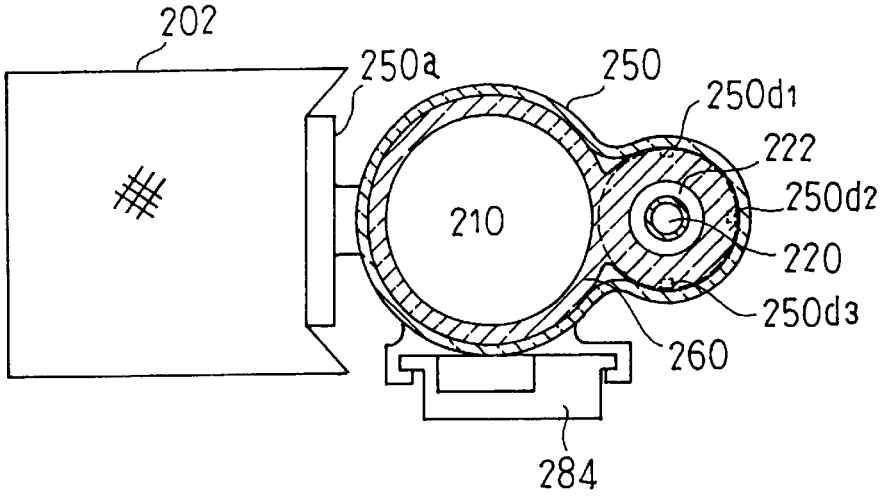
FIG. 5 is a sectional view taken along the line V—V in FIG. 2.

FIG. 2 is a partially enlarged sectional view showing the fuel pump unit of the fuel supply apparatus in FIG. 1. FIG. 3 is a top view of the fuel pump unit portion in FIG. 2. FIG. 4 is a sectional view taken along the line IV—IV in FIG. 2. FIG. 5 is a sectional view taken along the line V—V in FIG. 2. In FIG. 5, sectional illustration of the fuel pump, is omitted.

In FIG. 2, numeral 202 is an intake filter for sucking and filtering the fuel 102 from the fuel tank 100 when the fuel pump 210 is driven. The intake filter 202 is composed of a mesh portion 204 made of a nylon material or the like and a bush portion 206 for pressing and inserting the mesh portion 204 into a connecting portion (a first connecting portion) 250*a* of a pump holding case 250 and connecting them.

Numeral 210 is, for example, a Westco type fuel pump disclosed in Japanese Patent Publication (examined) No. 63756/1988. When a driving power is supplied through a connector 274 (see FIG. 3), the fuel pump 210 raises a pressure of the fuel sucked from an intake port 212 and discharges the fuel from a discharge port 214. In the drawing, power line and control line for connecting the connector 274 and the fuel pump 210 are not shown. The fuel pump 210 is fixed by an inner bottom wall 250*c* (the lower side in FIG. 2) of the pump holding case 250 through a cushion rubber (rubber member) 216 mounted on a pump cover 213 formed by, for example, aluminum die-casting on the intake port 212 side (lower side in FIG. 2). The fuel pump 210 is also fixed to a retaining portion 262*a* through a rubber bush 218 having a through hole for passing the fuel passes on the discharge port 214 side (upper side in FIG. 2).

The cushion rubber 216 positions and fixes the fuel pump 210, and further serves as a passage for guiding the fuel sucked from the intake filter 202 through connecting portions 250*a* and 250*b* to the intake port 212. The cushion rubber 216 is composed of an elastic body such as butyl nitrile rubber or fluorine rubber.

Figure 6:
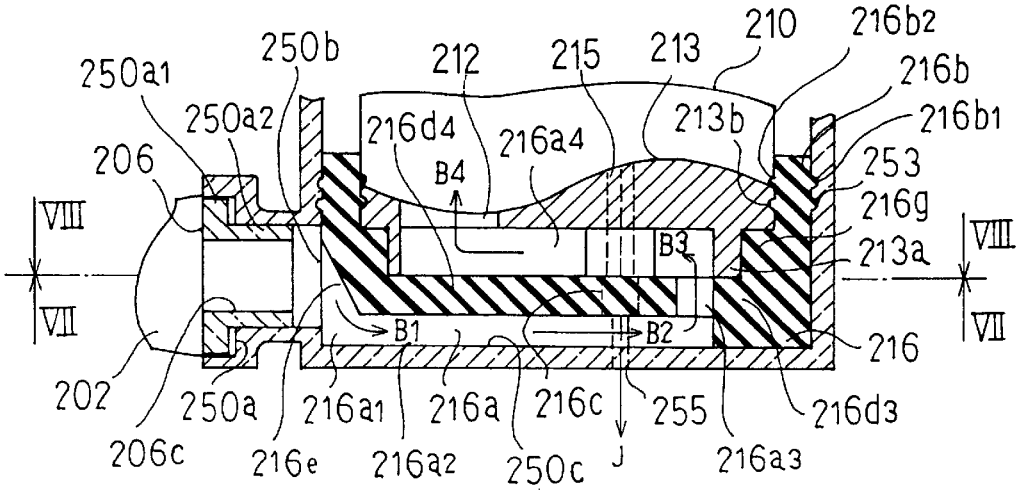
FIG. 6 is an enlarged sectional view showing the fuel pump intake side FIG. 2.
Figure 7:
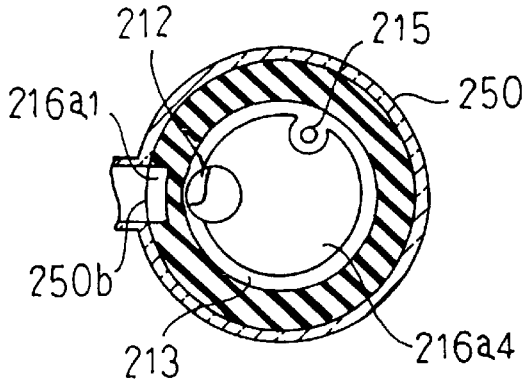
FIG. 7 is a sectional view taken along the line VII—VII in FIG. 6.
Figure 8:
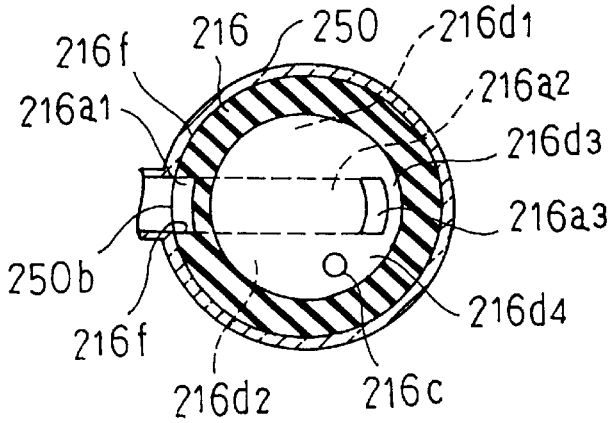
FIG. 8 is a sectional view taken along the line VIII—VIII in FIG. 6.

Now, construction of the cushion rubber 216 is hereinafter described with reference to the drawings. FIG. 6 is an enlarged sectional view showing the fuel pump intake side in FIG. 2. FIG. 7 is a sectional view taken along the line VII—VII in FIG. 6, and FIG. 8 is a sectional view taken along the line VIII—VIII in FIG. 6.

Numeral 216*a* is a passage (bypass) comprised of an intake portion 216*a*1 , a case-side communicating groove 216*a*2, a return portion 216*a*3, and a pump-side communicating groove 216*a*4. The intake portion 216*a*1 is formed being partitioned by a tapered portion 216*e,* the inner bottom wall 250*c* and a side wall 216*f* (see FIG. 8) of the cushion rubber 216, and communicates to the connecting portion (the second connecting portion) 250*b* that is an opening on an inner side of the pump holding case 250. As a result of forming the tapered portion 216*e,* the fuel can be smoothly guided in the direction of an arrow B1. The connecting portion 250*b* is formed long in the height direction (the up-and-down direction in FIG. 6) with respect to a tapered face of the tapered portion 216*e,* which results in effective reduction in pressure loss of flow.

The case-side communicating groove 216*a*2 is formed being partitioned by a rectangular parallelepiped-shaped groove with bottom portions 216*d*1, 216*d*2, and 216*d*3 (see FIG. 8) of the cushion rubber 216, the inner bottom wall 250*c,* and a plate-shaped portion 216*d*4. The fuel passes in the direction of an arrow B2, reaches the return portion 216*a*3 communicating to an end of the case-side communicating groove 216*a*2, thus the fuel is conveyed in the direction of an arrow B3. The return portion 216*a*3 is an opening provided on the plate-shaped portion 216*d*4.

The pump-side communicating groove 216*a*4 is formed into a short cylindrical configuration with the plate-shaped portion 216*d*4 and the pump cover 213. As indicated by an arrow B4, the fuel is sucked into the fuel pump 210 through the intake port 212 provided at an end of the pump-side communicating groove 216*a*4.

Numeral 215 is a vent hole provided on the pump cover 213, and numeral 216*c* is a vent hole provided on the plate-like portion 216d4 of the cushion rubber 216 and communicating to the vent hole 215. Numeral 255 is a vent hole provided on the pump holding case 250 and communicating to the vent hole 216*c*. Gas produced during the process of raising the pressure in the fuel pump 210 passes through the vent holes 215, 216*c,* and 255 and is discharged to outside of the fuel pump unit 200 as indicated by an arrow J.

Returning to FIG. 2, numeral 220 is the pressure regulator for keeping the pressure of the fuel discharged from the fuel pump 210 at a predetermined value. The pressure regulator 220 is press-fitted in a retaining portion 264 of a filter holding case 260 through an O-ring 222, and the other side thereof is fixed by ribs 250*d*1, 250*d*2, and 250*d*3 (see FIGS. 2 and 5) of the pump holding case 250.

Numeral 230 is a hollow cylindrical fuel filter for filtering the fuel discharged from the fuel pump 210, and comprises a filtration element 232 composed of a filter paper or the like and a holding member 234 for keeping the filtration element 232 held in the filter holding case 260. After inserting the filter 230 in the filter holding case 260 and holding it by the holding member 234, a cover member 262 is joined to the filter holding case 260, or they are integrally welded together.

Numeral 240 is a check valve that is disposed in a passage on an opening 238 (see FIG. 4) side of the fuel filter 230 and keeps the pressure in the delivery pipe 272 when stopping the engine. The check valve 240 is positioned with respect to a holding portion 262*b* of the filter holding case 260 (the cover member 262) and the flange 270 through a rubber bush 242 provided with a through hole.

Numeral 250 is the pump holding case for hermetically covering the intake port side of the fuel pump 210 to accommodate and hold the fuel pump 210. Molding a thermoplastic resin such as polyacetal, for example, forms the pump holding case 250. The pump holding case 250 is fixed to the filter holding case 260 by engaging an engaging hole 254 of the pump holding case 250 with an engaging claw 266 of the filter holding case by snap fitting. A center gauge 284 (see FIG. 5) for detecting a level, of the fueling the fuel tank 100 is attached to the outer periphery of the pump holding case 250. The filter holding case 260 is provided with a center gauge harness 286 (see FIG. 4) for supporting the center gauge 284. The connecting portions 250*a* and 250*b* are integrally formed with the pump holding case 250 by a resin.

Numeral 260 is the filter holding case fixed to the flange 270 by engaging an engaging claw with an engaging hole not shown by snap fitting.

Numeral 270 is a flange fixed fluid-tight to the fuel tank 100 by a seal packing (not shown) attached to a collar portion 276 of the flange 270. The flange 270 is provided with a breather pipe 280 (see FIG. 3) and a cut-off valve 282.

Numeral 278 is a fuel-flowing out hole (outlet) provided on the flange 270. When more than a predetermined amount of fuel delivered from the pressure regulator 220 flows into a fuel holding portion 290, the fuel is flowed out from the fuel pump, unit 200 to the fuel tank 100 through this fuel-flowing out hole 278. It is preferable to form plural fuel-flowing out holes 278 in order to reduce the noise generated at the time of flowing out the fuel to the fuel tank 100.

The fuel holding portion 290 is comprised of a space 290*a* formed among the inner wall of the pump holding case 250, the fuel pump 210, and the pressure regulator 220, a crescent-shaped space 290*b* (see FIG. 4) formed between the fuel pump 210 and the fuel filter 230 in the filter holding case 260, and a space 290*c* formed between the inner wall of the flange 270 and internal components thereof (more specifically, the cover member 262, the breather pipe 280 and the cut-off valve 282).

In this embodiment, the holding case as set forth in claims is comprised of three members, i.e., the pump holding case 250, the filter holding case 260, and the flange 270. It is also preferable that instead of these three members, one member, two members, or three or more members form the holding case, thus number of the members is not limited to three.

Assembling

Now, assembling the fuel supply system is described.

First, the fuel filter 230 is held by the filter holding case 260, the cover member 262 is joined to the filter holding case 260, or the cover member 262 and the filter holding case 260 are integrally welded, and thereafter, the rubber bush 218 is mounted on the discharge port of the fuel pump 210, and this fuel pump 210 is press-fitted in the cover member 262.

Subsequently, under the state of fitting the 0-ring 222 on the pressure regulator 220, the pressure regulator 220 is press-fitted in the filter holding case 260. The cushion rubber 216 is mounted on the side of the intake port 212 of the fuel pump 210. In this process, referring to FIG. 6, an outer periphery side of an annular protrusion 213*a* of the pump cover 213 is fitted and fixed to a fitting portion 216*g* of the cushion rubber 216, and a partition 216*b* is fitted and fixed to an outer periphery of the fuel pump 210. Then, the pump holding case 250 is attached to the filter holding case 260 by snap-fitting engagement. At this time, the partition 216*b* of the cushion rubber 250 is interposed fluid-tight between the fuel pump 210 and the inner wall of the pump holding case 250. Furthermore, referring to FIG. 6, an annular protrusion portion 216*b*1 formed on the partition 216*b* fits in an annular groove 253 formed on the pump holding case 250, and an annular protrusion portion 216*b*2 formed on the partition 216*b* fits in an annular groove 213*b* formed on the pump cover 213, and consequently, they are fixed fluid-tight and positioned with accuracy.

Figure 9:
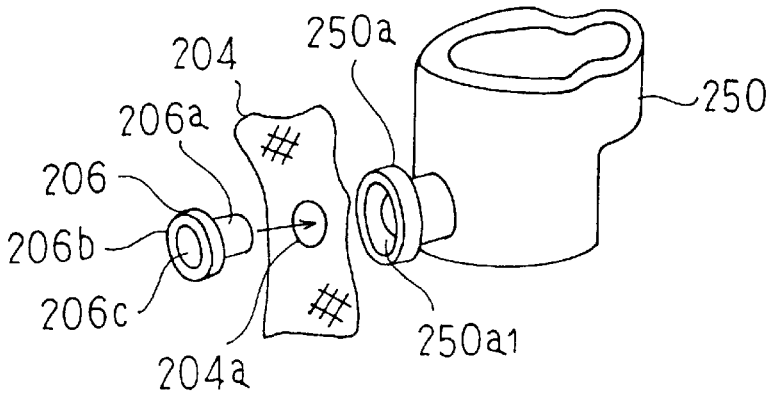
FIG. 9 is a schematic view for explaining the assembling of an intake filter according to Embodiment 1.

Now referring to FIG. 9, the intake filter 202 is described. FIG. 9 is a schematic view to explain assembling of the intake filter. The pump holding case 250 is integrally provided with the connecting portion 250*a* having a through hole 250*a*1 by resin molding. The bush portion 206 is comprised of an insert portion 206*a* to be press-fitted in the through hole 250*a*1 of the connecting portion 250*a*, an annular portion 206*b* having an external form larger than the insert portion 206*a* to inhibit further insertion into the through hole 250*a*1, and a through hole 206*c* provided through the center of the insert portion 206*a* and the annular portion 206*b*. To mount the intake filter 202 on the pump holding case 250, the press-fitted portion 206*a* of the bush portion 206, passing through the mounting hole 204*a* of the filter portion 204, is inserted in the through hole 250*a*1 of the connecting portion 250*a* by press-fitting. In this process, it is preferable to interpose a sealing member not shown in the drawings between the press-fitted portion 206*a* and the through hole 250*a*1 in order to seal them more hermetically.

Subsequently, the check valve 240 is disposed in the filter holding case 260 (the cover member 262), and after mounting the filter holding case 260 on the flange 270 under the state of fitting the rubber bush 242 on the check valve 240, this fuel pump unit 200 is inserted from the opening 108 of the fuel tank 100. Then the collar portion 276 is screwed in and fixed to the fuel tank 100 through a blanket and a seal packing not shown.

Fuel Supply Operation

Now, operation of supplying the fuel is described. In FIG. 2, arrows A to H indicate flow of the fuel.

When; a driving power is supplied from the connector 274 and a command to supply the fuel to the engine not shown is received from a control system not shown, the fuel pump 210 starts its operation.

By the operation of the fuel pump 210, the fuel 102 in the fuel tank 100 passes through the intake filter 202, passes through the connecting portion 250 a and the connecting portion 250*b* of the pump holding case 250 as indicated by the arrow A, passes through the passage 216*a* in the cushion rubber 216 as indicated by the arrow B, and is sucked from the intake port 212 of the fuel pump 210.

An impeller not shown rotates to raise the pressure of the fuel sucked into the fuel pump 210, and after the fuel is discharged from the discharge port 214, the fuel passes through a passage 263 provided in the filter holding case 260 as indicated by the arrow C.

If the pressure of the fuel that has passed through the passage 263 and is almost reaching the fuel filter 230 is higher than a predetermined value, the fuel is kept at the predetermined pressure by being branched into the pressure regulator 220 as indicated by the arrow D. The rest of the fuel passes through the filtration element 232 from an opening 236 of the fuel filter 230 as indicated by the arrow E and arrow F and is discharged from the opening 237. In addition, the pressure regulator 220 is disposed on the upstream side (the fuel tank 100 side) of the fuel filter 230 in this example. It is also preferable that the pressure regulator 220 is disposed on the downstream side of the fuel filter 230.

The fuel discharged from the opening 237 passes through the check valve 240, passes through the delivery pipe 272 as indicated by the arrow G and arrow H, and is supplied to the engine through an injector now shown.

As described above, the intake port 212 side of the fuel pump 210 is hermetically covered with the pump holding case 250, and therefore any noise generated near the intake port 212 when the fuel is sucked is shut off and is hardly conveyed directly to the outside of the fuel pump unit 200, i.e., to the inside of the fuel tank 100.

The connecting portion 250*a* protrudes from the pump holding case 250, and therefore any noise generated near the intake port 212 when the fuel is sucked is shut off and is hardly conveyed directly to the inside of the fuel tank 100.

The connecting portion 250*a* is integrally formed with the pump holding case 250, and therefore it is possible to dispose the intake filter 202 easily and increase rigidity of the connecting portion 250*a* as compared with the case of directly connecting the fuel pump 210 to the intake filter 202 by a tubular member.

The connecting portions 250*a* and 250*b* are provided on the pump holding case 250, and the cushion rubber 216 is provided with the passage 216*a* for connecting the connecting portion 250*b* to the intake port 212. As a result, number of parts is reduced and the apparatus is easily assembled as compared with the conventional construction in which the intake filter and the intake port are connected by a connecting pipe and the fuel pump is supported by the pump holder through the rubber member.

The passage 216*a* of the cushion rubber 216 is U-shaped, and therefore any noise generated near the intake port 212 when the fuel is sucked is hardly conveyed to the inside of the fuel tank 100.

The passage 216*a* of the cushion rubber 216 is U-shaped in the axial direction of the fuel pump 210 (the direction in which "U" is turned 90° counterclockwise in the sectional view shown in FIG. 6). As a result, it is possible to locate the intake port 212 of the fuel pump 210 close to the connecting portions 250*a* and 250*b*, thereby the noise being effectively reduced. In addition, the intake port 212 of the fuel pump 210 is provided in the pump cover 213, i.e., any intake pipe is not connected. It is therefore possible to shorten the fuel pump 210 in the axial direction and to small size the fuel pump unit 200.

Only a space for interposing the cushion rubber 216 is required between the intake port 212 side of the fuel pump 210 and the inner bottom wall 250*c* of the pump holding case 250. It is therefore possible to shorten the pump holding case 250 in the longitudinal direction (in the axial direction of the fuel pump 210) and to small size the fuel pump unit 200.

The fuel pump 210 is disposed in the pump holding case 250 through the elastic cushion rubber 216, and therefore any play to a certain extent is permissible and the system is easily assembled.

The partition 216*b* of the cushion rubber 216 separates the fuel that passed through the intake filter 202 from the fuel that passed through the pressure regulator 220, and therefore the entire construction becomes simple and the system is easily assembled.

The pressure regulator 220 is hermetically covered with the pump holding case 250, and therefore it is possible to shut off any noise generated when the fuel passes through the pressure regulator 220.

The fuel discharged from the pressure regulator 220 is not directly discharged into the fuel tank 100 but is temporarily held in the holding case comprised of the pump holding case 250, the filter holding case 260 and the flange 270. Then a portion of the fuel exceeding a predetermined amount is discharged from the fuel-discharging hole 278. As a result, the discharged fuel flows along the holding case into the fuel tank 100, whereby it is possible to reduce generation of noise.

In addition, for the purpose of reducing only the noise generated from the pressure regulator 220, it is not always necessary to hermetically cover the intake side of the fuel pump 210.

Embodiment 2

Figure 10:
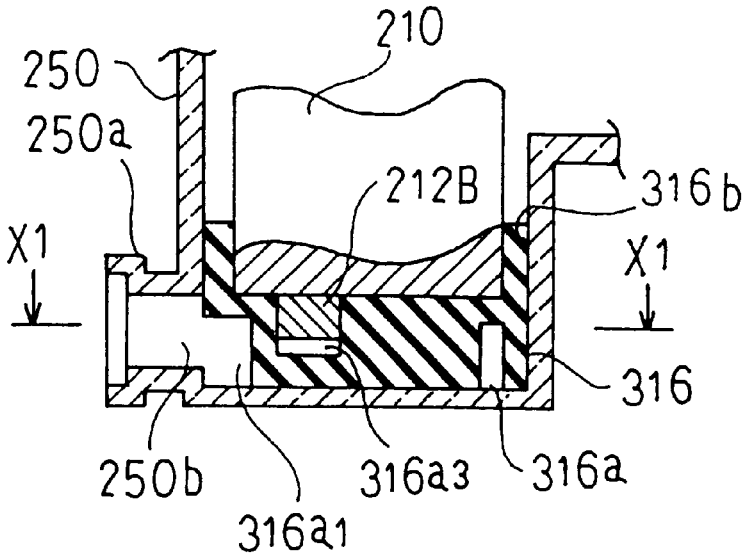
FIG. 10 is a partially enlarged sectional view showing a cushion rubber portion of a fuel supply system according to Embodiment 2 of the invention.
Figure 11:
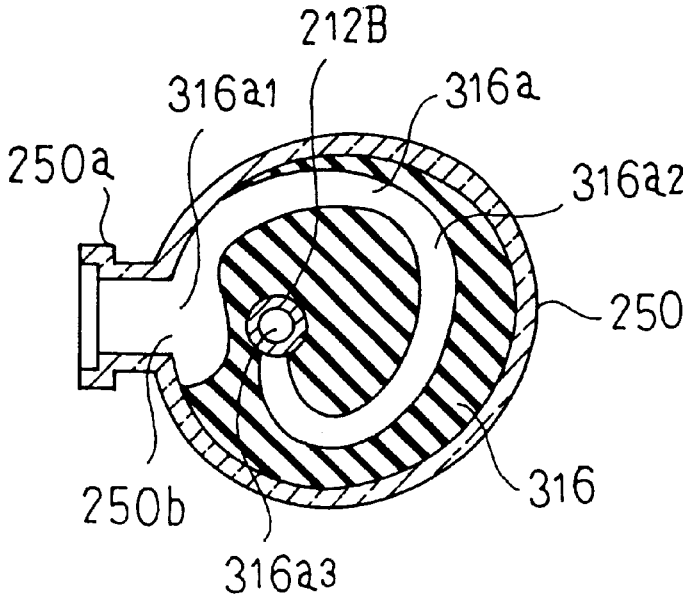
FIG 11 is a sectional view taken along the line XI—XI in FIG. 10.

FIG. 10 is an enlarged sectional view showing a cushion rubber portion of a fuel supply apparatus according to Embodiment 2 of the invention. FIG. 11 is a sectional view taken along the line XI—XI in FIG. 10. In the drawings, numeral 316 is a cushion rubber having a spiral passage 316*a* and a partition 316*b* interposed fluid-tight between the fuel pump 210 and the inner wall of the pump holding case 250. The passage 316*a* is comprised of an opening portion 316*a*1 communicating to the connecting portion 250*b* of the pump holding case 250, a passage portion 316*a*2 forming a spiral passage with the inner wall of the pump holding case 250, and a joining portion 316*c* provided at an end of the passage portion 316*a*2 and in which an intake pipe 212B of the fuel pump 210 is press-fitted. Height (dimension in vertical direction in FIG. 10) of the opening portion 316*a*1 is formed to be smaller than a communication hole (equivalent to numeral 206 in FIG. 6) of the connecting portion 250*b*. Length of the opening portion 316*a*1 is formed to be larger than the communicating hole in the circumferential direction (length in the clockwise direction in FIG. 11). Description of a vent for discharging any gas generated at the time of raising the pressure in the fuel pump 210 is omitted in Embodiment 2. The rest of the construction is the same as that in the foregoing Embodiment 1, and the description is omitted.

As described above, the passage 316*a* is formed to be spiral. Therefore any noise generated near the intake pipe 212B when the fuel is sucked are not directly conveyed to the inside of the fuel pump 100. Furthermore the cushion rubber 316 can be formed to be small in height (length in the vertical direction in FIG. 11) and it is possible to small size the fuel pump unit 200.

The opening portion 316*a*1 is lower than the communicating hole, and it is therefore possible to arrange the fuel pump 210 close to a bottom wall of the pump holding case 250 and small size the fuel pump unit 200.

The opening portion 316*a*1 is longer than the communicating hole in the circumferential direction, and it is therefore possible to reduce pressure loss of the flow.

The intake pipe 212B is press-fitted in the joining portion 316*c* of the cushion rubber 316, and therefore the intake pipe 212B is easily positioned. It is also preferable that the intake pipe 212B is provided in the form of a recession on the pump cover 213 in the same manner as in the foregoing Embodiment 1. In this case, it is possible to small size the fuel pump unit 200 in the direction of height (axial direction of the fuel pump 210).

Industrial Applicability

The invention described above is applicable to devices having engines such as motor bicycles, snowmobiles, etc. other than vehicles.

What is claimed is:

1. A fuel supply apparatus for supplying a fuel to an engine comprising:

a fuel tank;

a cylindrical fuel pump disposed in said fuel tank for raising a pressure of the fuel sucked from an intake port thereof and discharging the fuel from a discharge port thereof;

an intake filter having a filter connecting portion for filtering the fuel in said fuel tank and supplying the fuel to the intake port of said fuel pump;

a pressure regulator for regulating a pressure of the fuel discharged from the discharge port of said fuel pump;

a holding case covering at least the intake port side of said fuel pump and accommodating and holding said fuel pump; and a rubber member disposed in said holding case and interposed between the intake port side of said fuel pump and an inner surface of said holding case, wherein said holding case is integrally formed with a case connecting portion in which the filter connecting portion of said intake filter is hermetically connected and said holding case substantially and hermetically covers the intake port side of said fuel pump with the exception of the case connecting portion, said intake filter covers the case connecting portion of said holding case, and said rubber member forms at least a part of passage communicating the intake port of said fuel pump to the case connecting portion of said holding case.

2. The fuel supply apparatus according to claim 1, wherein the holding case includes a first connecting portion to be connected to a fuel filter, and a second connecting portion to be connected to the intake port of the fuel pump.

3. The fuel supply apparatus according to claim 2, wherein the intake port of the fuel pump and the second connecting portion of the holding case are connected through the bypass formed by the rubber member disposed in said holding case.

4. The fuel supply apparatus according to claim 3, wherein the rubber member serves as a cushion for said fuel pump.

5. The fuel supply apparatus according to claim 3, wherein the rubber member is interposed between an outer circumference of the fuel pump and an inner circumference of the holding case and is provided with a partition for partitioning the bypass.

6. The fuel supply apparatus according to claim 1, wherein the holding case hermetically accommodates the pressure regulator and is provided with a fuel holding portion for holding the fuel discharged from the pressure regulator and a flowing out portion for flowing out the fuel to the fuel tank when the fuel in said fuel holding portion exceeds a predetermined amount.

7. The fuel supply apparatus according to claim 6, wherein the flowing out portion is formed into plural holes.

8. A fuel supply apparatus for supplying a fuel to an engine comprising:

a fuel tank;

a cylindrical fuel pump disposed in said fuel tank for raising a pressure of the fuel sucked from an intake port thereof and discharging the fuel from a discharge port thereof;

an intake filter having a filter connecting portion for filtering the fuel in said fuel tank and supplying the fuel to the intake port of said fuel pump;

a holding case covering at least the intake port side of said fuel pump and accommodating and holding said fuel pomp; and a rubber member disposed in said holding case and interposed between the intake port side of said fuel pump and the inner surface of said holding case, wherein said holding case is integrally provided with a case connecting portion in which the filter connecting portion of said intake filter is hermetically connected and said holding case substantially and hermetically covers the intake port side of said fuel pump with exception of the case connecting portion, said intake filter covers the case connecting portion, and said rubber member forms at least a part of passage communicating the intake port of said fuel pump to the case connecting portion of said holding case.

* * * * *